US008844567B2

(12) United States Patent
Lockhart

(10) Patent No.: US 8,844,567 B2
(45) Date of Patent: Sep. 30, 2014

(54) MANIFOLD FOR REFRIGERATION SYSTEM

(76) Inventor: Douglas Lloyd Lockhart, Cobble Hill (CA)

( * ) Notice: Subject to any disclaimer, the term of this patent is extended or adjusted under 35 U.S.C. 154(b) by 987 days.

(21) Appl. No.: 12/948,345

(22) Filed: Nov. 17, 2010

(65) Prior Publication Data

US 2011/0120578 A1 May 26, 2011

Related U.S. Application Data

(60) Provisional application No. 61/263,721, filed on Nov. 23, 2009.

(51) Int. Cl.
*F16K 11/22* (2006.01)
*F25B 41/00* (2006.01)
*F25B 45/00* (2006.01)

(52) U.S. Cl.
CPC ..... *F25B 41/003* (2013.01); *F25B 2345/006* (2013.01); *F25B 45/00* (2013.01)
USPC ..... 137/597; 137/551; 137/625.4; 137/883; 137/887; 251/208

(58) Field of Classification Search
CPC ..... F16K 5/201; F16K 5/12; F16K 37/00; F16K 37/0075; F16K 11/20; F16K 3/34
USPC ..... 137/625.4, 625.41, 637, 887, 861, 551, 137/597, 883, 613; 73/756; 62/50.7; 251/208, 209
See application file for complete search history.

(56) References Cited

U.S. PATENT DOCUMENTS

| | | | | |
|---|---|---|---|---|
| 3,883,113 | A * | 5/1975 | Kolb | 251/209 |
| 5,524,863 | A * | 6/1996 | Davis | 251/127 |
| 5,558,124 | A * | 9/1996 | Randall | 137/597 |
| 6,360,619 | B1 * | 3/2002 | Schultz, Jr. | 73/863.86 |

* cited by examiner

*Primary Examiner* — Kevin L Lee
*Assistant Examiner* — P. Macade Nichols
(74) *Attorney, Agent, or Firm* — Geoffrey deKleine; Borden Ladner Gervais LLP

(57) ABSTRACT

A manifold, for a refrigeration system, includes a body comprising a bore hole extending through the body, and a plurality of ports including a first process port for adding and removing refrigerant, and a first side port for mechanical connection thereto. The manifold also includes a first ball valve disposed in the body, between the first process port and the first side port. The first ball valve includes a ball recess aligned with the bore hole through the body, and a ball port extending generally transverse to the ball recess and in fluid connection therewith. The ball port includes a narrow end and wider end. The first ball valve is moveable between an open position in which the ball port is aligned with the first side port and the first side port is in fluid connection with the bore hole through the body, and a closed position in which the ball port is out of alignment with the first side port.

12 Claims, 4 Drawing Sheets

MANIFOLD FOR REFRIGERATION SYSTEM

CROSS REFERENCE TO RELATED APPLICATIONS

This application claims the benefit of Provisional Application No. 61/263,721, filed on Nov. 23, 2009, the entire contents of which is incorporated herein by reference.

TECHNICAL FIELD

The present application relates to a manifold for fluid connection to a compressor in a refrigeration system and for control of the addition or removal of refrigerant or evacuation of the refrigeration system.

BACKGROUND DISCUSSION

With the elimination of all chlorine based refrigerants and the advent of new multiple component refrigerants the Heating Ventilating Air Conditioning and Refrigeration (HVAC/R) trade is having to adjust some of it's methodology with respect to the needs of these new refrigerants. These refrigerants that are two or more components that do not act like a single component refrigerant and are typically called zeotropes, near azeotropes or ternary blends. Since these multiple component chemical brews have to be maintained in tight mix ratio tolerances, they must also be handled carefully in the field to maintain these ratios. In addition to problems with leaks in the system causing gassing off of the component having the highest vapour pressure and leaving an unknown mix, charging or topping up of the system by poorly trained or ignorant refrigeration mechanics charging vapour from a refrigerant drum containing a blend is problematic. If the charging occurs from a drum with a blend in the vapour form, it is likely that the refrigeration system is charged with an unknown blend that has no predictable performance. Thus, it is desirable to charge such systems with liquid in a controllable manner.

SUMMARY

According to one aspect, there is provided a manifold for a refrigeration system. The manifold includes a body comprising a bore hole extending through the body, and a plurality of ports including a first process port for adding and removing refrigerant, and a first side port for mechanical connection thereto. The manifold also includes a first ball valve disposed in the body, between the first process port and the first side port. The first ball valve includes a ball recess aligned with the bore hole through the body, and a ball port that narrows to a fine slit, the ball port extending generally transverse to the ball recess and in fluid connection therewith. The first ball valve is moveable between an open position in which the ball port is aligned with the first side port and the first side port is in fluid connection with the bore hole through the body, and a closed position in which the ball port is out of alignment with the first side port.

Advantageously, the manifold includes a ball-valve with a ball port that narrows to a fine slit at the narrow end of the ball port. This fine slit facilitates fine control of the opening and closing of the ball-valve between a low side port and the bore hole through the body. A similar ball valve may be provided to facilitate fine control of the opening and closing of the ball-valve between a high side port and the bore hole through the body. This very fine control facilitates throttling down, or moving from an open to a closed position, and opening up, or moving from a closed position to an open position, reducing the chance of dangerous overfeeding. Ternary blends, zeotropes and near azeotropic refrigerant blends are fed into a refrigeration system in liquid form. Fine control of the opening and closing protects a refrigeration compressor coupled to the body while facilitating servicing.

According to another aspect, there is provided a manifold for a refrigeration system. The manifold includes a body that has a bore hole extending through the body, and a plurality of ports including a first process port for adding and removing refrigerant, and a first side port for mechanical connection thereto. A first shuttle valve is disposed in the body, between the first process port and the first side port. The first shuttle valve includes a valve tube and a shuttle slideable along the valve tube, between an open position in which the first process port is in fluid connection with the first side port and a closed position in which the first process port is out of fluid connection with the first side port.

Advantageously, process hoses may be connected to process ports and may be utilized by opening and quickly closing valves such as the ball valve or shuttle valve, providing efficient connection to process ports and efficient control of the connection.

Other aspects and features will become apparent to those ordinarily skilled in the art upon review of the following description of specific embodiments in conjunction with the accompanying figures.

BRIEF DESCRIPTION OF THE DRAWINGS

Embodiments of the present application will now be described, by way of example only, with reference to the attached figures, wherein.

DETAILED DESCRIPTION

Figure 1:
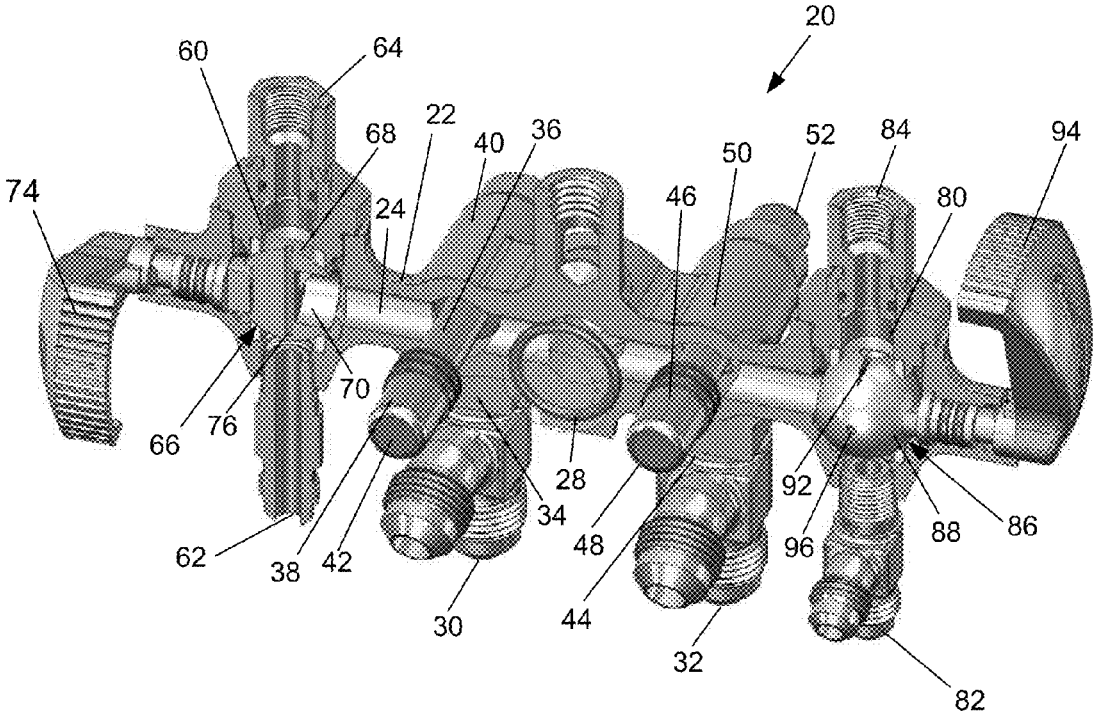
FIG. 1 is a perspective orthogonal cutaway view of a manifold according to an embodiment.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limited to the embodiments described herein.

Referring to the figures a manifold 20 for a refrigeration system is shown. The manifold 20 generally includes a body 22 comprising a bore hole 24 extending through the body 22, and a plurality of ports including a first process port 34. for adding and removing refrigerant, and a first side port 30 for mechanical connection thereto. The manifold 20 also includes a first ball valve assembly 66 disposed in the body, between the first process port 30 and the first side port. The first ball valve assembly 66 includes a ball recess 70 aligned with the bore hole 24 through the body 22, and a ball port that narrows to a fine slit, the ball port extending generally transverse to the ball recess and in fluid connection therewith. The first ball valve assembly 66 is moveable between an open position in which the ball port is aligned with the first side port and the first side port is in fluid connection with the bore hole through the body, and a closed position in which the ball port is out of alignment with the first side port.

Figure 4:
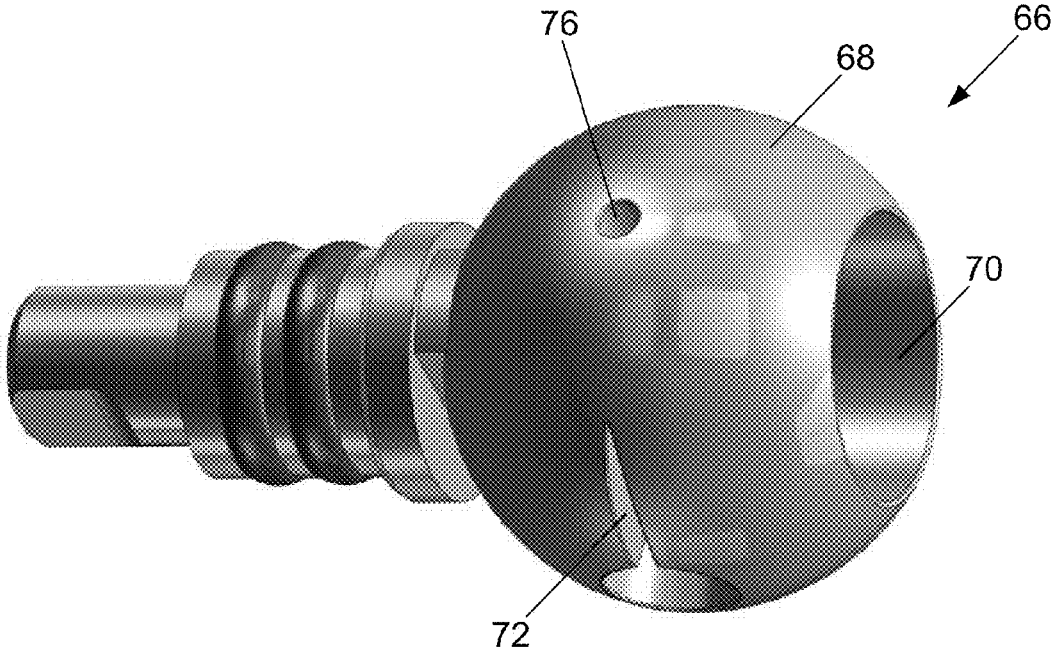
FIG. 4 is a perspective view of a portion of a ball valve assembly of FIG. 1.

Referring now to FIG. 1, through FIG. 4, the manifold 20 is described in further detail. The manifold 20 includes a body 22 which may be constructed of, for example, machined or forged metal. A bore hole 24 extends along the body 22. A sight glass 26 may be provided, for example, at a center of the body 22. The sight glass 26 is made of glass that is sufficiently thick and suitable strength to withstand the high pressures encountered in Heating Ventilating Air Conditioning and Refrigeration (HVAC/R) systems. The sight glass 26 is secured to the body 22 in any suitable manner and is sealed utilizing a suitable O-ring.

A first process port 30 and a second process port 32 are located on opposing sides of the sight glass 26. The first process port 30 is disposed at the end of a central port tube 34, the first process port 30 includes a mechanical connection for adding and removing refrigerant.

A shuttle valve assembly 36 is disposed along the bore hole 24 in the body 22, at the connection of the central port tube 34 with the bore hole 24 in the body 22. The shuttle valve assembly 36 includes a shuttle 38, or slide-style button, that is operable to move, along a valve tube 40, between an open position in which the first process port 30 is in fluid connection with the bore hole 24 in the body 22 and a closed position in which the first port 30 is closed and therefore not in fluid connection with the bore hole 24 in the body 22. The shuttle valve assembly 36 shown in FIG. 1 is in the closed position and is moved to the open position by pressing the shuttle 38 at the end 42 to cause the shuttle 38 to move along the valve tube 40. The shuttle 38 is moved to the closed position by pressing on the opposite end to cause the shuttle 38 to move in the reverse direction. In both the open and closed positions, the portion of the bore hole 24 on one side of the shuttle valve assembly 36 is in fluid connection with the portion of the bore hole 24 on the other side of the shuttle valve assembly 36. When the shuttle valve assembly 36 is in the open position, the refrigerant may be added to or removed from the system via evacuation with a vacuum pump.

The second process port 32 is located on the opposing sides of the sight glass 26 as the first process port 30 and is disposed at the end of a central port tube 44, the second process port 32 includes a mechanical connection for evacuating the system utilizing a vacuum pump.

Figure 2:
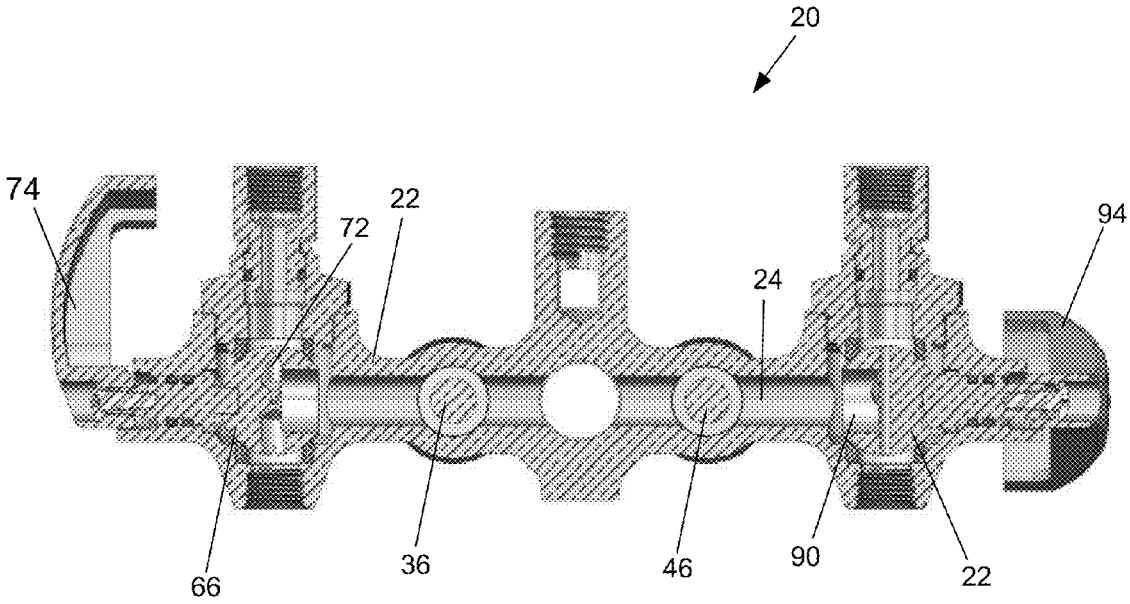
FIG. 2 is a side sectional view of the manifold of FIG. 1.

A shuttle valve assembly 46 is disposed along the bore hole 24 in the body 22, at the connection of the central port tube 44 with the bore hole 24 in the body 22. The shuttle valve assembly 46 includes a shuttle 48, or slide-style button, that is operable to move, along a valve tube 50, between an open position in which the second process port 32 is in fluid connection with the bore hole 24 in the body 22 and a closed position in which the second process port 30 is closed and therefore not in fluid connection with the bore hole 24 in the body 22. The shuttle valve assembly 46 shown in FIG. 1 is in the open position and is moved to the closed position by pressing the shuttle 48 at the end 52 (shown in FIG. 2), to cause the shuttle 48 to move along the valve tube 50. The shuttle 48 is moved to the closed position by pushing on the opposite end to cause the shuttle 48 to move in the opposite direction. In both the open and closed positions, the portion of the bore hole 24 on one side of the shuttle valve assembly 46 is in fluid connection with the portion of the bore hole 24 on the other side of the shuttle valve assembly 46.

First and second side port tubes 60, 80 extend generally transverse to the bore hole 24 in the body 22. Referring to the first side port tube 60, the tube includes opposing ends 62, 64 with one end for connection to a low side or inlet side of a compressor pump (not shown) of the system, and for mechanical connection of measurement instruments such as, for example, bourdon tube dial gauges, electronic head or other pressure or temperature indicator at the other end.

Figure 3:
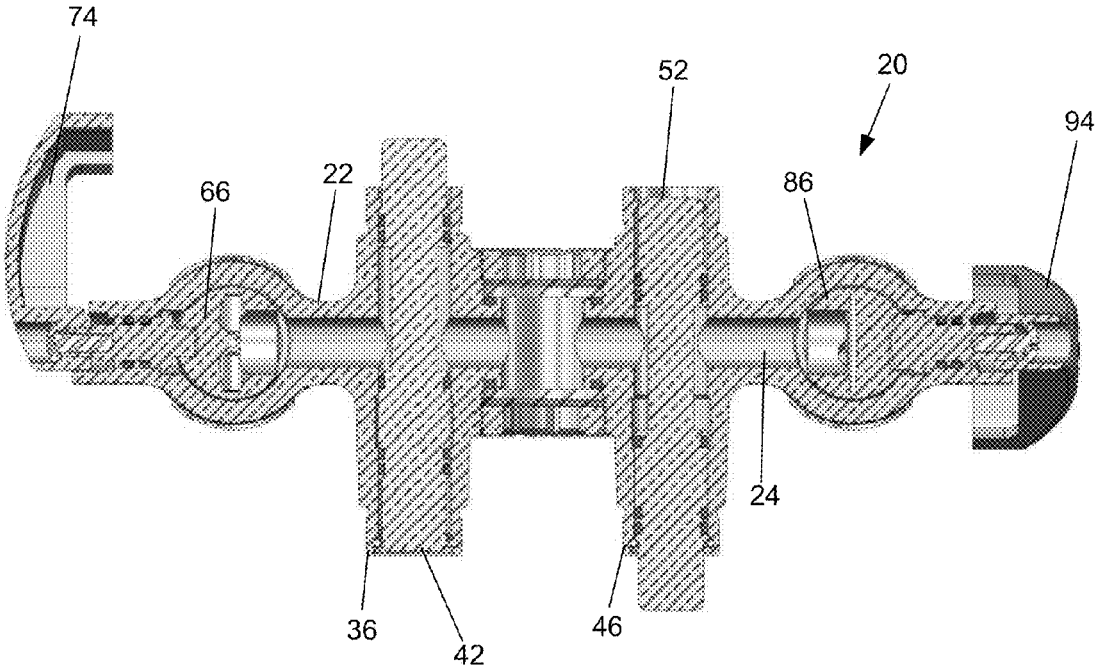
FIG. 3 is a bottom sectional view of the manifold of FIG. 1.

A first ball valve assembly 66 is disposed in the body 22, at the connection of the first side port tube 60 with the bore hole 24 to control fluid connection of the first side port tube 60 with the bore hole 24. The first ball valve assembly 66 is shown in FIG. 4 as well as FIG. 1 through FIG. 3. The first ball valve assembly 66 includes a generally spherical ball 68 with a recess 70 extending less than one half the distance into the spherical ball 68 and aligned with the bore hole 24 of the body 22. The spherical ball 68 is seated between washers of, for example, Teflon™. Two ports 72 are included in the spherical ball 68. Each port 72 extends radially and generally transverse to the recess 70, from the recess 70, to the exterior of the spherical ball 68. Each port 72 includes a narrow end and a wider opposing end. In the embodiment shown in the figures, each port 72 is generally V-shaped with a cylindrical hole at the wide end of the V. Other suitable port shapes may be utilized to provide a narrow slit at one end, however. The two ports 72 are generally aligned diametrically across the spherical ball 68 and each provide a fluid connection with the recess 70 to the exterior of the spherical ball 68.

A handle 74 is connected to the spherical ball 68 by mechanical interlock with a cut-away portion of the spherical ball 68, on an opposite side of the spherical ball 68 as the recess 70. Rotation of the handle 74 causes rotation of the spherical ball 68 to move the ball valve assembly 66 between an open position in which each of the ports 72 is in fluid communication with the first side port tube 60 and a closed position in which each of the ports 72 is not in fluid communication with the first side port tube 60. The handle 74 may be adjusted to control the amount of the ports 72 that provide fluid communication with the first side port tube 60. Therefore, the handle 74 may be rotated to control the size of the opening, or percentage of the ports 72, connecting the first side port tube 60 with the bore hole 24 of the body 22. For example, the handle 74 may be adjusted such that only a very small portion of the narrow slit at the end of each port 72 is aligned with the first side port tube 60. The handle 74 may also be adjusted to increase the percentage of the ports 72 aligned with the first side port tube 60 by a very small increment. The ports 72, including the narrow slit, facilitate very fine adjustment of the size of the opening between the ends 62, 64 of the first side port tube and the bore hole 24. The ends 62, 64 therefore provide ports through which refrigerant may be added or removed from the system and to which measurement instruments may be mechanically connected.

The spherical ball 68 also includes a channel 76 extending through the ball such that when the ball valve assembly 66 is in the closed position, the opposing ends 62, 64 of the first side port tube 60 are still in fluid communication through the first side port tube 60 and through the channel 76. The channel 76 is not in fluid communication with either of the ports 72 or with the recess 70. The channel 76 provides fluid communication between the ends 62, 64 when the ball valve assembly 66 is in the closed position. The ports 72 and the recess 70 provide fluid communication between the ends 62, 64 when the ball valve assembly 66 is in the open position.

The second side port tube 80 is similar to the first side port tube 60. The second side port tube 80 is disposed on an opposite side of the body 22 and includes opposing ends 82, 84, with one end for connection to a high side or outlet side of a compressor pump (not shown) of the system, via a hose, and for mechanical connection of measurement instruments such as, for example, bourdon tube dial gauges, electronic head or other pressure or temperature indicator at the opposing end.

A second ball valve assembly 86 is disposed in the body 22, at the connection of the second side port tube 80 with the bore hole 24 to control fluid connection of the second side port tube 80 with the bore hole 24. The second ball valve assembly 86 is similar to the first ball valve assembly shown in FIG. 4 and in FIG. 4 through FIG. 3. The second ball valve assembly 86 includes a generally spherical ball 88 with a recess 90 extending less than one half the distance into the spherical ball 88 and aligned with the bore hole 24 of the body 22. The spherical ball 88 is seated between washers of, for example, Teflon™. Two ports 92 are included in the spherical ball 98. Each port 92 extends radially and generally transverse to the recess 90, from the recess 90, to the exterior of the spherical ball 88. Each port 92 includes a narrow end and a wider opposing end. In the embodiment shown in the figures, each port 92 is generally V-shaped with a cylindrical hole at the wide end of the V. Other suitable port shapes may be utilized to provide a narrow slit at one end, however. The two ports 92 are generally aligned diametrically across the spherical ball 88 and each provide a fluid connection with the recess 90 to the exterior of the spherical ball 88.

A handle 94 is connected to the spherical ball 88 by mechanical interlock with a cut-away portion of the spherical ball 88, on an opposite side of the spherical ball 88 as the recess 90. Rotation of the handle 94 causes rotation of the spherical ball 88 to move the ball valve assembly 86 between an open position in which each of the ports 92 is in fluid communication with the first side port tube 80 and a closed position in which each of the ports 92 is not in fluid communication with the first side port tube 80. The handle 94 may be adjusted to control the amount of the ports 92 that provide fluid communication with the first side port tube 80. Therefore, the handle 94 may be rotated to control the size of the opening, or percentage of the ports 92, connecting the first side port tube 80 with the bore hole 24 of the body 22. For example, the handle 94 may be adjusted such that only a very small portion of the narrow slit at the end of each port 92 is aligned with the first side port tube 80. The handle 94 may also be adjusted to increase the percentage of the ports 92 aligned with the first side port tube 80 by a very small increment. The ports 92, including the narrow slit facilitate very fine adjustment of the size of the opening between the ends 82, 84 of the first side port tube and the bore hole 24. The ends 82, 84 therefore provide ports through which refrigerant may be added or removed from the system and to which measurement instruments may be mechanically connected.

The spherical ball 88 also includes a channel 96 extending through the ball such that when the ball valve assembly 86 is in the closed position, the opposing ends 82, 84 of the first side port tube 80 are still in fluid communication through the first side port tube 80 and through the channel 96. The channel 96 is not in fluid communication with either of the ports 92 or with the recess 90. The channel 96 provides fluid communication between the ends 82, 84 when the ball valve assembly 86 is in the closed position. The ports 92 and the recess 90 provide fluid communication between the ends 82, 84 when the ball valve assembly 86 is in the open position.

The two sides of the body 22 are therefore similar and include similar ports and valve assemblies.

The ball-valve assemblies with a port that narrows to a fine slit facilitates fine control of the opening and closing of the respective ball-valve assembly between a low side port and the bore hole through the body. A ball valve with a port that narrows to a fine slit also facilitates fine control of the opening and closing of the ball-valve between a high side port and the bore hole through the body. This fine control facilitates very fine control of the flow to reduce dangerous overfeeding. Ternary blends, zeotropes and near azeotropic refrigerant blends that are fed into a refrigeration system in liquid form may be finely controlled by fine control of the opening and closing of the ball valves to protect the refrigeration compressor coupled to the body while facilitating servicing.

The ball valve assemblies also include an internal channel that facilitates fluid connection of one side of the respective side port tube to the opposing side of the respective side port tube. This fluid connection is maintained so that pressure exerted on the HVAC/R system low side sample port, connected to one end of a side port tube by a remote hose, is in fluid connection with gauges on an opposing side of the side port tube. Similarly, the pressure exerted on the HVAC/R system high side sample port connected to one end of the other side port tube by a remote hose, is in fluid connection with gauges on the opposing side of the other side port tube.

In another embodiment, a single process port may be provided for connection to add or remove refrigerant and to evacuate the system. In this embodiment, the ball valve assemblies may be utilized to control flow, without utilizing shuttle valves.

The valves at the process ports, or the valve in the case of the single process port, is not limited to a shuttle valve assembly as described. Other valves may be utilized. Similarly, other valves or valve combinations may be utilized rather than the ball valve as described herein. For example, diaphragm or globe style valve with a floating piston may or may not be used in conjunction with the shuttle valve assembly to accomplish the same function.

In the preceding description, for purposes of explanation, numerous details are set forth in order to provide a thorough understanding of the embodiments of the present application. However, it will be apparent to one skilled in the art that certain specific details are not required. The above-described embodiments are intended to be examples only. Alterations, modifications and variations can be effected to the particular embodiments by those of skill in the art without departing from the scope of the present application, which is defined solely by the claims appended hereto.

What is claimed is:

1. A manifold for a refrigeration system, the manifold comprising:

a body comprising a bore hole extending through the body, and a plurality of ports including a first process port for adding and removing refrigerant, and a first side port extending generally transverse to the borehole, for mechanical connection thereto;

a first ball valve disposed in the body, between the first process port and the first side port, the first ball valve comprising a first ball having a recess that extends generally radially into the ball from an exterior surface of the first ball, and that is aligned with the bore hole through the body, and a first ball port that extends generally radially in the first ball and generally transverse to a radial direction of the recess, from the recess to the exterior surface of the first ball such that the ball port is in fluid communication with the recess, wherein the first ball port narrows to a fine slit from a wide end, the first ball valve moveable between an open position in which the first ball port is aligned with the first side port and the first side port is in fluid connection with the bore hole through the body, and a closed position in which the first ball port is out of alignment with the first side port, wherein the body comprises a first port tube having mechanical connections at each end, one of the mechanical connections comprising the first side port, the first ball valve disposed between the ends of the first port tube and the first ball valve comprises a channel extending therethrough for fluidly connecting the ends of the first port tube when the first ball valve is in the closed position, the channel extending out of communication with the first ball port and the recess of the first ball valve.

2. The manifold according to claim 1, wherein the body comprises a second side port for mechanical connection thereto.

3. The manifold according to claim 2, comprising a second process port and a second ball valve disposed in the body, between the second process port and the second side port, the second ball valve comprising a second ball having a second recess that extends generally radially into the ball from an exterior surface of the first ball, and that is aligned with the bore hole through the body, and a second ball port that extends generally radially in the second ball and generally transverse to a radial direction of the second recess, from the second recess to the exterior surface of the second ball such that the second ball port is in fluid communication with the recess, wherein the second ball port narrows to a fine slit, the second ball valve moveable between an open position in which the second ball port is aligned with the second side port and the second side port is in fluid connection with the bore hole through the body, and a closed position in which the second ball port is out of alignment with the second side port.

4. The manifold according to claim 1, comprising a first shuttle valve disposed between the first process port and the bore hole through the body, the first shuttle valve moveable between an open position in which the bore hole through the body is in fluid connection with the first process port and a closed position in which the bore hole through the body is out of connection with the first process port.

5. The manifold according to claim 4, comprising a second process port for mechanical connection to evacuate the refrigeration system.

6. The manifold according to claim 5, comprising a second shuttle valve disposed between the second process port and the bore hole through the body, the second shuttle valve moveable between an open position in which the bore hole through the body is in fluid connection with the second process port and a closed position in which the bore hole through the body is out of connection with the second process port.

7. The manifold according to claim 1, comprising a sight glass disposed near the first process port.

8. The manifold according to claim 1, comprising a sight glass disposed between the first process port and the second process port.

9. The manifold according to claim 1, wherein the body comprises a second port tube having mechanical connections at each end, one of the mechanical connections comprising the second side port, the second ball valve disposed between the ends of the second port tube.

10. The manifold according to claim 9, wherein the second ball valve comprises a channel extending therethrough for fluidly connecting the ends of the second port tube when the second ball valve is in the closed position, the channel extending out of communication with the second ball port and the second recess of the second ball valve.

11. The manifold according to claim 1, comprising a handle connected to the first ball valve for moving the ball valve between the open and closed positions.

12. The manifold according to claim 10, comprising a first handle connected to the first ball valve for moving the first ball valve between the open and closed positions and a second handle connected to the second ball valve for moving the second ball valve between the open and closed positions.

* * * * *